US007690766B2

(12) United States Patent
Ueno et al.

(10) Patent No.: US 7,690,766 B2
(45) Date of Patent: Apr. 6, 2010

(54) LIQUID EJECTION HEAD, LIQUID EJECTION DEVICE AND LIQUID EJECTION METHOD

(75) Inventors: Nobuhiro Ueno, Takatsuki (JP); Yasuo Nishi, Hachioji (JP); Atsuro Yanata, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 342 days.

(21) Appl. No.: 11/793,083

(22) PCT Filed: Dec. 7, 2005

(86) PCT No.: PCT/JP2005/022442

§ 371 (c)(1),
(2), (4) Date: Jun. 15, 2007

(87) PCT Pub. No.: WO2006/067966

PCT Pub. Date: Jun. 29, 2006

(65) Prior Publication Data

US 2008/0150975 A1 Jun. 26, 2008

(30) Foreign Application Priority Data

Dec. 20, 2004 (JP) ..... 2004-367810

(51) Int. Cl.
*B41J 2/06* (2006.01)

(52) U.S. Cl. ..... 347/55; 347/68

(58) Field of Classification Search ..... 347/54, 347/55, 68, 70–72
See application file for complete search history.

(56) References Cited

U.S. PATENT DOCUMENTS 5,828,393 A 10/1998 Hotomi
5,896,148 A * 4/1999 Fukushima et al. ..... 347/67
6,036,302 A 3/2000 Hotomi
6,048,050 A 4/2000 Gundlach et al.
6,341,851 B1 1/2002 Takayama et al.

FOREIGN PATENT DOCUMENTS

EP 1104696 A1 6/2001

(Continued)

OTHER PUBLICATIONS

International Search Report for International Application No. PCT/JP2005/022442 mailed Feb. 21, 2006.

(Continued)

*Primary Examiner*—Juanita D Stephens
(74) *Attorney, Agent, or Firm*—Cantor Colburn LLP

(57) ABSTRACT

A liquid ejection head having: a nozzle for ejecting a liquid; a flat nozzle plate on which the nozzle is provided; a cavity to store the liquid to be ejected from an ejection hole of the nozzle; a pressure generating section which generates pressure on the liquid in the nozzle and forms a meniscus of the liquid in the ejection hole of the nozzle; an electrostatic voltage applying section which applies electrostatic voltage between a base material and the liquid in the nozzle and the cavity, and generates electrostatic suction force; and an operation control section which controls applying of the electrostatic voltage by the electrostatic voltage applying section, and controls applying of drive voltage to drive the pressure generating portion, wherein a volume resistivity of the nozzle plate is $10^{15}$ Ωm or more.

17 Claims, 7 Drawing Sheets

FOREIGN PATENT DOCUMENTS

| | | | |
|---|---|---|---|
| JP | 5-104725 | | 4/1993 |
| JP | 5-278212 | | 10/1993 |
| JP | 6-134992 | | 5/1994 |
| JP | 10-278238 | | 10/1998 |
| JP | 2001-191535 | | 7/2001 |
| JP | 2003-53977 | | 2/2003 |
| JP | 2004-136656 A | | 5/2004 |
| JP | 2007181971 A | * | 1/2006 |

OTHER PUBLICATIONS

European Search Report for Application No./Patent No. 05814693.7-1251/1829688 PCT/JP2005022442 dated Nov. 2, 2009.

* cited by examiner

LIQUID EJECTION HEAD, LIQUID EJECTION DEVICE AND LIQUID EJECTION METHOD

CROSS REFERENCE TO RELATED APPLICATIONS

This is a U.S. national stage of application No. PCT/JP2005/022442, filed on 07 Dec. 2005. Priority under 35 U.S.C. §119(*a*) and 35 U.S.C. §365(*b*) is claimed from Japanese Application No. 2004-367810, filed 20 Dec. 2004, the disclosure of which is also incorporated herein by reference.

TECHNICAL FIELD

The present invention relates to a liquid ejection head, a liquid ejection device and a liquid ejection method, and in particular, to a liquid ejection head of an electric field concentration type having a flat nozzle, a liquid ejection device employing the liquid ejection head and a liquid ejection method employing the aforesaid liquid ejection head and the liquid ejection device.

BACKGROUND

In recent years, with a background of development of a trend toward high-definition of image quality in inkjet and expansion of a range of application thereof in an industrial use, demands for fine pattern forming and ejection of high viscosity ink grow greater increasingly. When these problems are attempted to be solved by a conventional inkjet recording method, minimization of nozzles and improvement of liquid ejection force for ejecting high viscosity ink are needed, resulting in high drive voltage and extreme cost increase for a head and a device, which has prevented realization of a device that is suited to practical use.

To meet the aforesaid demands, therefore, there has been known, as a technology to eject not only a low viscosity liquid droplet but also a high viscosity liquid drop from a minimized nozzle, the liquid droplet ejection technology of the so-called electrostatic suction method wherein a liquid in a nozzle is charged electrically, and a liquid droplet is ejected by electrostatic suction force caused by an electric field that is formed between the nozzle and various base materials representing a target that receives an impact of the liquid droplet (see Patent Document 1).

However, when a flat liquid ejection head of this kind is used in the liquid droplet ejection technology of the electrostatic suction method, an extent of electric field concentration for a liquid in a nozzle and for a meniscus of a ejection hole portion is low, and it has been necessary to apply extremely high voltage as voltage to be applied between the liquid ejection head and the base materials, for obtaining necessary electrostatic suction force.

Therefore, there has been advancement of development of a liquid droplet ejection device employing the so-called an electric field assist method wherein this liquid droplet ejection technology and a technology to eject a liquid droplet by using pressure caused by a transformation of a piezoelectric element or by generation of bubbles inside a liquid are combined (for example, see Patent Documents 2-5). This electric field assist method is a method wherein a meniscus forming section and electrostatic suction force are used to protrude a liquid meniscus on an orifice of a nozzle, and thereby to enhance electrostatic suction force for the meniscus so that the electrostatic suction force may overcome a surface tension of a liquid to change the meniscus into a liquid droplet to eject it.

Patent Document 1: International Application Publication No. 03/070381 A1

Patent Document 2: Japanese Patent Publication Open to Public Inspection No. H5-104725

Patent Document 3: Japanese Patent Publication Open to Public Inspection No. H5-278212

Patent Document 4: Japanese Patent Publication Open to Public Inspection No. H6-134992

Patent Document 5: Japanese Patent Publication Open to Public Inspection No. 2003-53977

Compared with an inkjet recording method employing a conventional piezoelectric system or a thermal system, in these liquid ejection devices employing the electric field assist method, electrostatic suction force by electric field is not utilized to its maximum level although the ejection efficiency is satisfactory, thus, forming of the meniscus and ejection of a liquid droplet are not conducted efficiently, and when trying to meet the demands for fine pattern forming and ejection of high viscosity ink, drive voltage needs to be higher, resulting in a cost increase of a head and a device in the same way as in the conventional inkjet recording method, which has been a problem. Further, when voltage to be applied is boosted for enhancing electrostatic suction force, dielectric breakdown is caused between a head and base materials, which sometimes makes it impossible to drive the device, which has also been a problem.

When a flat liquid ejection head is used as a liquid ejection head on which a nozzle for ejecting a liquid is provided, in these liquid ejection devices each employing an electric field assist method, there are great advantages that productivity is excellent because of simple structures, and a nozzle is not caught by a wiper in the case of wiping of a ejection surface when a liquid ejection head is cleaned.

However, even in the case of the liquid ejection device employing the electric field assist method wherein pressure is generated by a transformation of a piezoelectric element, to protrude a liquid meniscus on an ejection hole of a nozzle, and electric field is concentrated selectively on the protruded meniscus to eject a liquid by electrostatic suction force, an action to draw out a meniscus by electrostatic suction force for forming a meniscus is poor because of poor electric field concentration, resulting in necessity of applying high voltage on pressure generating portion that is composed of piezoelectric element actuators such as piezoelectric elements, which has been a problem.

Incidentally, in the invention, a flat nozzle, a nozzle plate and a liquid ejection head mean those wherein a protrusion of a nozzle from a ejection surface of the nozzle plate is 30 μm or less, and they mean those wherein a trouble such as damage is not caused in the course of the aforesaid wiping, and a nozzle protrusion is small and no effect of electric field is expected.

In the liquid ejection device employing the electric field assist method for solving problems of this flat liquid ejection head, therefore, a liquid ejection head wherein a nozzle is protruded in a shape of a lightning rod toward the ejection surface side from a nozzle plate of the liquid ejection head, to enhance ejection efficiency of the nozzle by concentrating electric field to the tip of the protrusion of the nozzle, is used in many cases.

However, a large number of nozzles each being in a lightning rod shape having a height of about several tens μm need to be embedded toward the ejection surface side from the nozzle plate of the liquid ejection head, which makes the structure to be complicated, and lowers productivity. Further, there has been a problem of poor operability that embedded nozzles are broken in the course of cleaning of the liquid ejection head.

DISCLOSURE OF THE INVENTION

Therefore, an objective of the invention is to provide a liquid ejection head wherein an electric field assist method that controls an amount of meniscus protrusion and controls ejection is used, a ejection surface is flat, meniscus forming drive can be switched with low voltage, electric field is concentrated effectively with impression of electrostatic voltage of low voltage, a liquid is ejected efficiently, and thereby, the fine pattern can be formed and a liquid of high viscosity can be ejected, a liquid ejection device and a liquid ejection method.

An embodiment of the liquid ejection head for attaining the aforesaid objectives is characterized in that a nozzle for ejecting a liquid, a flat nozzle plate on which the nozzle head is provided, a cavity to store a liquid ejected from an ejection hole of the nozzle, a pressure generating portion that generates pressure on a liquid in the aforesaid nozzle and forms a meniscus of a liquid on an ejection hole of the aforesaid nozzle, an electrostatic voltage applying portion that applies electrostatic voltage between liquids in the aforesaid nozzle and in the aforesaid cavity and base materials, and generates electrostatic suction force and an operation control section that controls applying of the aforesaid electrostatic voltage by the electrostatic voltage applying section and controls applying of drive voltage that drives the aforesaid pressure generating portion, are provided, and a volume resistivity of the aforesaid nozzle plate is $10^{15}$ Ωm or more.

DESCRIPTION OF THE PREFERRED EMBODIMENT

Figure 1:
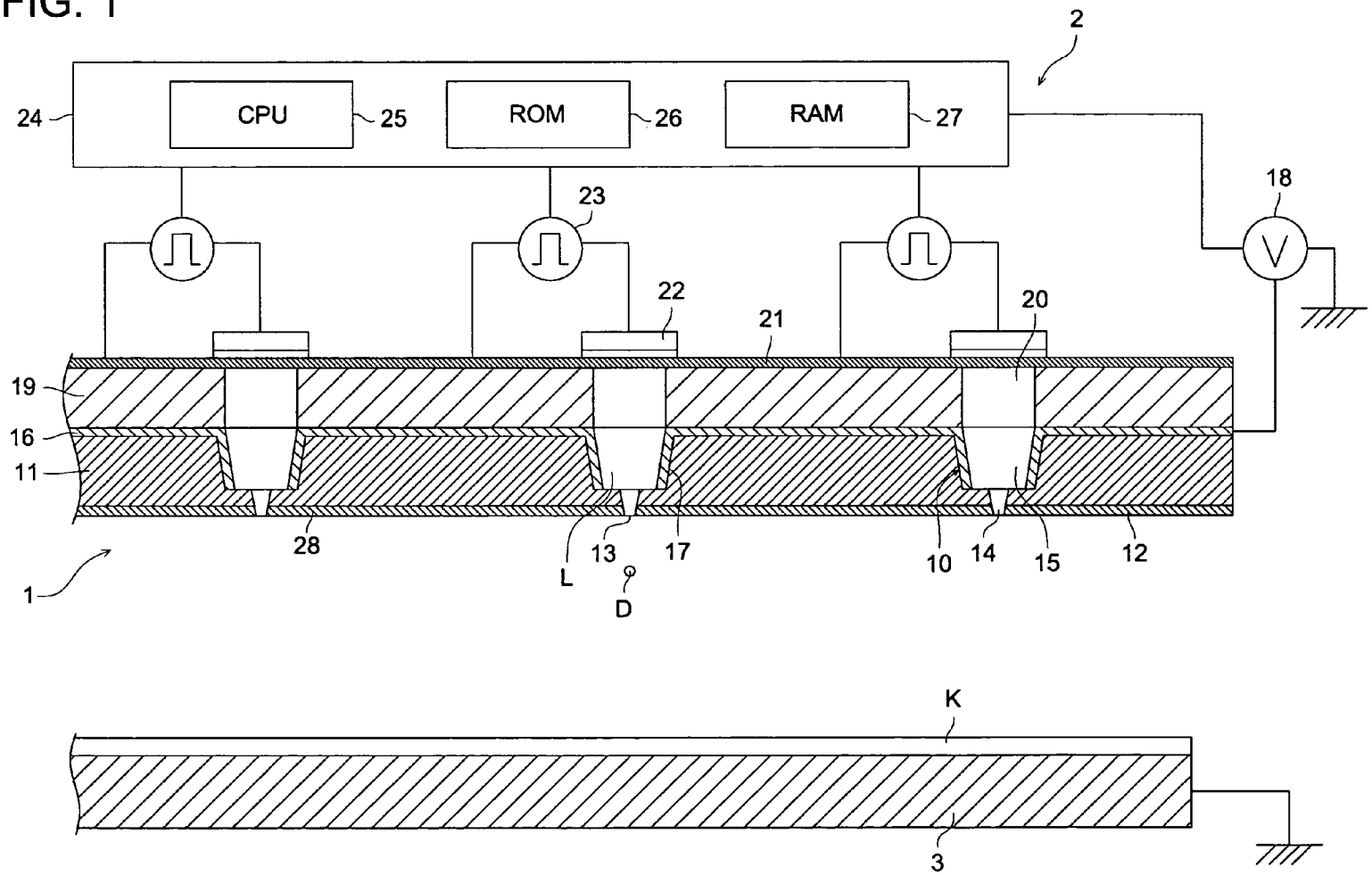
FIG. 1 is a sectional view showing an entire structure of a liquid ejection device relating to the present embodiment.

The aforesaid objectives of the invention are attained by the following structures.

(1) An liquid ejection head including a nozzle for ejecting a liquid, a flat nozzle plate on which the nozzle head is provided, a cavity to store a liquid ejected from an ejection hole of the nozzle, a pressure generating portion that generates pressure on a liquid in the aforesaid nozzle and forms a meniscus of a liquid on an ejection hole of the aforesaid nozzle, an electrostatic voltage applying portion that applies electrostatic voltage between liquids in the aforesaid nozzle and in the aforesaid cavity and base materials, and generates electrostatic suction force and an operation control section that controls applying of the aforesaid electrostatic voltage by the electrostatic voltage applying section and controls applying of drive voltage that drives the aforesaid pressure generating portion, wherein a volume resistivity of the aforesaid nozzle plate is $10^{15}$ Ωm or more.

According to the structure (1), electrostatic voltage is applied on liquids in a nozzle and a cavity of a liquid ejection head that is made of a material whose volume resistivity is $10^{15}$ Ωm or more and has a flat ejection surface, and thereby, the electric field is formed between the liquid ejection head and an opposing electrode, thus, pressure is added to a liquid in the nozzle by the pressure generating portion to form a liquid meniscus on an ejection hole of the nozzle, then, electric fields are concentrated on the meniscus, whereby, the meniscus is sucked by electrostatic suction force caused by electric field, to be changed into a liquid droplet to be ejected.

(2) The liquid ejection head described in the structure (1) is characterized in that the aforesaid liquid is one containing conductive solvent, and the absorption factor of the aforesaid liquid of the nozzle plate is 0.6% or less.

According to the structure (2), a liquid ejected from a nozzle of a liquid ejection head is one containing conductive solvent, while, volume resistivity of a nozzle plate is $10^{15}$ Ωm or more, and its absorption factor for a liquid is 0.6% or less.

(3) The liquid ejection head described in the structure (1) is characterized in that the aforesaid liquid is one wherein chargeable particles are dispersed in insulating solvent.

According to the structure (3), a liquid in which chargeable particles are dispersed in insulating solvent is ejected from a liquid ejection head having a nozzle plate whose volume resistivity is $10^{15}$ Ωm or more.

(4) The liquid ejection head described in any one item in the structure (1)-structure (3) is characterized in that a thickness of the aforesaid nozzle plate is 75 μm or more.

According to the structure (4), a nozzle is formed on a nozzle plate whose thickness is 75 μm or more, in the liquid ejection head described in any one item in the structure (1)-structure (3).

(5) The liquid ejection head described in any one item in the structure (1)-structure (4) is characterized in that an inner diameter of an ejection hole on the nozzle is 15 μm or less.

According to the structure (5), a nozzle is formed so that an inner diameter of an ejection hole is 15 μm or less in the liquid ejection head described in any one item in the structure (1)-structure (4).

(6) The liquid ejection head described in any one item in the structure (1)-structure (5) is characterized in that a liquid-repelling layer is provided on the ejection hole side of the aforesaid nozzle plate.

According to the structure (6), a liquid-repelling layer that repels a liquid is provided on the flat ejection hole side of the liquid ejection head.

(7) The liquid ejection head described in any one item in the structure (1)-structure (6) is characterized in that the pressure generating portion is a piezoelectric actuator.

In the invention described in structure (7), a piezoelectric element actuator such as a piezoelectric element is used as a pressure generating portion that generates pressure on a liquid in the nozzle and forms a liquid meniscus on an ejection hole of the nozzle.

(8) The liquid ejection device is characterized in that the liquid ejection head described in any one item in the structure (1)-structure (7) and an opposing electrode opposing to the liquid ejection head are provided, and the liquid is ejected by the electrostatic suction force generated between the liquid ejection head and the opposing electrode and by the pressure generated in the nozzle.

According to the structure (8), a meniscus is formed on an ejection hole of a nozzle by the pressure added by a pressure generating portion for a liquid in the nozzle of the liquid ejection head described in the structures (1)-(7), and by the electric field formed by electrostatic voltage applying section between the liquid ejection head and the opposing electrode, in the liquid ejection device, and thereby, strong electric field intensity is generated on the tip of the meniscus by electric field concentration, and a liquid is changed into a liquid droplet which is accelerated by electric field to make impact on the base material.

(9) The liquid ejection device described in the structure (8) is characterized in that a liquid meniscus is protruded on an ejection hole of the nozzle by the pressure caused by the pressure generating portion, and a liquid is ejected by the electrostatic suction force.

According to the structure (9), pressure is added by a pressure generating portion on a liquid in the nozzle of the liquid ejection head first to form a meniscus on an ejection hole portion, in the liquid ejection device described in structure (8), and then, the meniscus is torn off by the electrostatic suction force to be changed into a liquid droplet.

(10) The liquid ejection method is characterized in that a nozzle for ejecting a liquid is provided, electrostatic voltage is applied on liquids in a nozzle and a cavity of a liquid ejection head having a flat nozzle plate with volume resistivity of $10^{15}$ Ωm or more, to form an electric field between the liquid ejection head and an opposing electrode, and the pressure is generated on the liquid in the nozzle by a pressure generating section, whereby, electric field is concentrated on a liquid meniscus formed on an ejection hole of the nozzle by electrostatic suction force caused by the electric field and by the aforesaid pressure, so that the liquid is sucked by the aforesaid electrostatic suction force to be ejected.

According to the method (10), a meniscus is formed on an ejection hole of a nozzle by the actions of the pressure applied by a pressure generating portion for liquids in the nozzle and cavity of the liquid ejection head that is made of a material having volume resistivity of $10^{15}$ Ωm or more and has a flat ejection surface and of the electric field formed by the electrostatic voltage applying section between the liquid ejection head and the opposing electrode, and thereby, strong electric field intensity is generated on the tip of the meniscus by electric field concentration, and a liquid is changed into a liquid droplet which is accelerated by electric field to make impact on the base material.

(11) The liquid ejection method is characterized in that a nozzle for ejecting a liquid is provided, electrostatic voltage is applied on liquids in a nozzle and a cavity of a liquid ejection head having a flat nozzle plate with volume resistivity of $10^{15}$ Ωm or more, to form an electric field between the liquid ejection head and an opposing electrode, and the pressure is generated on the liquid in the nozzle by a pressure generating section, whereby, a liquid meniscus is protruded on an ejection hole of the nozzle and electric field is concentrated on the liquid meniscus, so that the liquid is sucked by the electrostatic suction force by the aforesaid electric field.

According to the method (11), a nozzle to eject a liquid is provided, the pressure is applied, by a pressure generating section, on liquids in a nozzle and a cavity of a liquid ejection head having a flat nozzle plate with volume resistivity of $10^{15}$ Ωm or more, to cause a meniscus to be protruded on an ejection hole portion, thereby, strong electric field intensity is generated on the tip of the meniscus by electric field concentration, thus, the meniscus is torn off by electrostatic suction force of the electric field to be changed into a liquid droplet which is accelerated by electric field to make impact on the base material.

(12) The liquid ejection method is characterized in that the liquid is one containing conductive solvent, and the absorptance of the nozzle plate for the liquid is 0.6% or less in the liquid ejection method described in (10) or (11).

According to the method (12), a liquid ejected from a nozzle of the liquid ejection head is one containing conductive solvent, and volume resistivity of the nozzle plate is $10^{15}$ Ωm or more and the absorptance thereof for the liquid is 0.6% or less.

(13) It is characterized in the liquid ejection method (10) or (11) that the aforesaid liquid is one wherein chargeable particles are dispersed in insulating solvent.

According to the method (13), a liquid wherein chargeable particles are dispersed in insulating solvent is ejected from a liquid ejection head having a nozzle plate whose volume resistivity is $10^{15}$ Ωm or more.

(14) It is characterized that a thickness of the nozzle plate is 75 μm or more in any one item of the liquid ejection methods (10)-(13).

According to the method (14), a liquid is ejected through a nozzle formed on the nozzle plate whose thickness is 75 μm or more.

(15) It is characterized that an inner diameter of an ejection hole of the nozzle is 15 μm or less, in any one item of the liquid ejection methods (10)-(14).

According to the method (15), a liquid is ejected from a nozzle on which an inner diameter of an ejection hole is 15 μm or less.

(16) It is characterized that a liquid-repelling layer is provided on the aforesaid ejection surface side of the nozzle plate, in any one item of the liquid ejection methods (10)-(15).

According to the method (16), a liquid-repelling layer that repels a liquid is provided on the flat ejection surface of the liquid ejection head from which a liquid is ejected.

(17) It is characterized that the aforesaid pressure generating section is a piezoelectric element actuator, in any one item of the liquid ejection methods (10)-(16).

According to the method (17), a piezoelectric element actuator such as a piezoelectric element is used as a pressure generating portion.

In below, embodiments of the liquid ejection head relating to the invention and of the liquid ejection device employing the liquid ejection head will be explained, referring to the drawings.

FIG. 1 is a sectional view showing an entire structure of a liquid ejection device relating to the present embodiment. Incidentally, liquid ejection head 2 of the invention can be applied to liquid ejection devices of various types such as the so-called serial system or a line system.

Liquid ejection device 1 of the present embodiment is provided with liquid ejection head 2 on which nozzle 10 that ejects liquid droplet D of chargeable liquid L such as ink is formed and with opposing electrode 3 that has an opposing surface that opposes nozzle 10 of the liquid ejection head 2 and supports base material K that catches the impact of liquid droplet D on the opposing surface.

On the side of the liquid ejection head 2 opposing to the opposing electrode 3, there is provided nozzle plate made of resin having a plurality of nozzles 10. The liquid ejection head 2 is constructed as a head having a flat ejecting surface from which the nozzle 10 is not protruded from ejection surface 12 facing opposing electrode 3 of nozzle plate 11, or from which the nozzle 10 is not protruded by an amount exceeding 30 μm (for example, see FIG. 2 (D) described later).

Each nozzle 10 is formed on nozzle plate 11 through boring, and each nozzle 10 is made to be of the two-step structure including small diameter portion 14 having ejection hole 13 on ejection surface 12 of each nozzle plate 11 and large diameter portion 15 located behind the small diameter portion. In the present embodiment, the small diameter portion 14 and the large diameter portion 15 of the nozzle 10 are formed to be in a taper-shaped form wherein each cross section is circular and an opposing electrode side is made to be a smaller diameter, and an arrangement is made so that an inner diameter (hereinafter referred to as a nozzle diameter) of ejection hole 13 of the small diameter portion 14 may be 10 μm, and an inner diameter of an opening edge that is farthest from the small diameter portion 14 of the large diameter portion 15 may be 75 μm.

Figure 2:
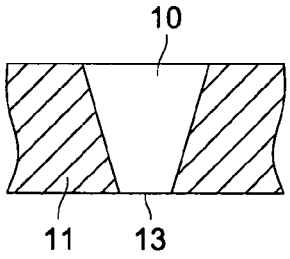
FIG. 2 is a diagram showing a variation of a nozzle having a different shape.
Figure 2:
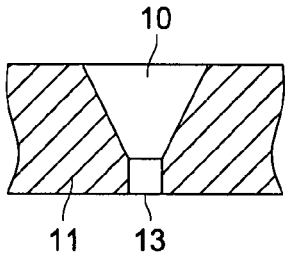
Figure 2:
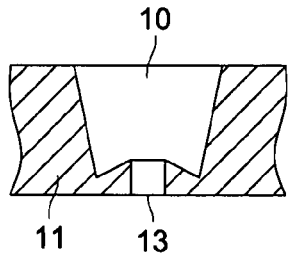
Figure 2:
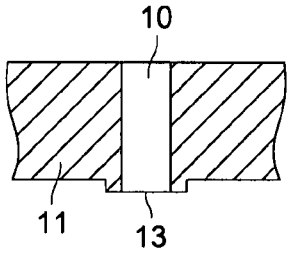
Figure 2:
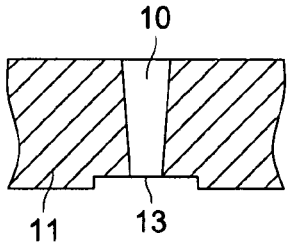

In the meantime, a shape of the nozzle 10 is not limited to the aforesaid shape, and for example, various nozzles 10 each being different in terms of a shape as shown in FIGS. 2 (A)-2 (E) can be used. Further, the nozzle 10 may be in a polygonal shape and in a starry shape in place of a circular shape in its cross section.

On the surface opposite to ejection surface 12 on the nozzle plate 11, there is provided electrode 16 for charging that is made of a conductive material such as NiP, for example, and electrifies liquid L in the nozzle 10, in a form of a layer. In the present embodiment, the electrode 16 for charging is extended to the inner circumferential surface 17 of large diameter portion 15 of the nozzle 10 to be in contact with liquid L in the nozzle.

Further, the electrode 16 for charging is connected to charging-voltage power source 18 serving as an electrostatic voltage applying section that applies electrostatic voltage that generates electrostatic suction force, and single electrode for charging 16 is in contact with all liquids L in the nozzle 10, whereby, an arrangement is made so that liquids L in all nozzles 10 may be electrified simultaneously, and electrostatic suction force may be generated between liquid ejection head 2 and opposing electrode 3, especially between liquid L and base material K, electrostatic voltage is applied to the electrode 16 for charging from the charging-voltage power source 18.

Body layer 19 is provided behind the electrode 16 for charging. On a portion that faces the opening edge of large diameter portion 15 of the aforesaid each nozzle 10 of the body layer 19, there is formed a space that has an inner diameter which is nearly the same as each opening edge and is cylindrical practically, and each space is made to be cavity 20 for storing temporarily liquid L ejected.

Flexible layer 21 that is composed of a metallic thin plate having flexibility or of silicone is provided behind the body layer 19, and liquid ejection head 2 is isolated from the outside by the flexible layer 21.

In the meantime, an unillustrated channel for supplying liquid L to the cavity 20 is formed on the body layer 19. Specifically, a silicone plate representing the body layer 19 is subjected to etching processing, and cavity 20, a common channel and a channel that connects the common channel and cavity 20 are provided, and the common channel is connected with an unillustrated supply tube that supplies liquid L from an unillustrated liquid tank in the outside, so that prescribed supply pressure may be given to liquids L in a channel, cavity 20 and nozzle 10 by an unillustrated supply pump provided on a supply tube or by a pressure difference caused by a position of arrangement of the liquid tank.

Piezoelectric element 22 representing a piezoelectric actuator that serves as a pressure generating section is provided on a portion corresponding to each cavity 20 on the outer surface of the flexible layer 21, and drive voltage power source 23 to apply drive voltage on the element and thereby to deform the element is connected to the piezoelectric element 22. When drive voltage is applied from the drive voltage power source 23, the piezoelectric element 22 is deformed to generate pressure on liquid L in the nozzle and thereby to form a meniscus of liquid L on ejection hole 13 of the nozzle 10. Incidentally, for the pressure generating section, an electrostatic actuator and a thermal system, for example, may also be employed, in addition to the piezoelectric actuator in the present embodiment.

The drive voltage power source 23 and the charging-voltage power source 18 which applies electrostatic voltage on the electrode 16 for charging are respectively connected to action-control section 24 to be controlled by the action-control section 24.

In the present embodiment, the action-control section 24 is composed of a computer wherein CPU 25, ROM 26 and RAM 27 are connected by an unillustrated BUS, and CPU 25 causes the charging-voltage power source 18 and the drive voltage power source 23 to drive to eject liquid L from ejection hole 13 of the nozzle 10, based on power source control program stored in ROM 26.

In the meantime, with respect to the nozzle plate, those made of a material whose volume resistivity is $15^{15}$ Ωm or more may be used as they are, or those wherein a thin film (for example, $SiO_2$ film) having volume resistivity of $15^{15}$ Ωm or more on the ejecting surface side may be used.

In the present embodiment, liquid-repelling layer 28 for controlling bleed-out of liquid L from ejection hole 13 is provided on the entire ejecting surface 12 other than the ejection hole 13 for the ejecting surface 12 of nozzle plate 11 of liquid ejection head 2. For the liquid-repelling layer 28, a material having water repellency is used when liquid L is aqueous, for example, and a material having oil repellency is used when liquid L is oily. In general, however, fluorine resins such as FEP (ethylene tetrafluoride-propylene hexafluoride), PTFE (polytetra-fluoroethylene), fluorine-containing siloxane, fluoroalkylsilane and amorphous perfluoro resins are used in many cases, and they are cast on ejection surface 12 through a coating method or a vacuum evaporation method. Incidentally, the liquid-repelling layer 28 may be either cast directly on the ejection surface 12 of nozzle plate 11, or cast through an intermediate layer for improving adhesion properties of the liquid-repelling layer 28.

Under liquid ejection head 2, there is arranged flat-plate-shaped opposing electrode 3 that supports base material K to be in parallel with ejection surface 12 of liquid ejection head 2 and to be away from it by a prescribed distance. A distance between the opposing electrode 3 and liquid ejection head 2 is established properly within a range of about 0.1-3 mm.

In the present embodiment, the opposing electrode 3 is grounded and is maintained at the grounding potential constantly. Accordingly, if electrostatic voltage is applied on electrode 16 for charging from the charging-voltage power source 18, an electric field is generated between liquid L in ejection hole 13 of nozzle 10 and an opposing surface that faces liquid ejection head 2 of the opposing electrode 3. It is further arranged so that the opposing electrode 3 may set its electric charges free through grounding when charged liquid droplet D makes impact on base material K.

In the meantime, an unillustrated positioning section that positions liquid ejection head 2 and base material K by moving them relatively is attached on the opposing electrode 3 or the liquid ejection head 2, and owing to this, liquid droplet D ejected from each nozzle 10 of the liquid ejection head 2 can be made to make impact at an optional position on the surface of base material K.

With respect to liquid L to be ejected by liquid ejection device 1, examples of an inorganic liquid include water, $COCL_2$, HBr, $HNO_3$, $H_3PO_4$, $H_2SO_4$, $SOCl_2$, $SO_2Cl_2$ and $FSO_3H$.

Further listed as organic liquids are alcohols such as methanol, n-propanol, isopropanol, n-butanol, 2-methyl-1-propanol, tert-butanol, 4-methyl-2-pentanol, benzyl alcohol, α-terpineol, ethylene glycol, glycerin, diethylene glycol, or triethylene glycol; phenols such as phenol, o-cresol, m-cresol, or p-cresol; ethers such as dioxane, furfural, ethylene glycol dimethyl ether, methyl cellosolve, ethyl cellosolve, butyl cellosolve, ethyl carbitol, butyl carbitol, butyl carbitol acetate, or epichlorohydrin; ketones such as acetone, methyl ethyl ketone, 2-methyl-4-pentanone, or acetophenone; fatty acids such as formic acid, acetic acid, dichloroacetic acid, or trichloroacetic acid; esters such as methyl formate, ethyl formate, methyl acetate, ethyl acetate, n-butyl acetate, isobutyl acetate, 3-methoxybutyl acetate, n-pentyl acetate, ethyl propionate, ethyl lactate, methyl benzoate, diethyl malonate, dimethyl phthalate, diethyl phthalate, diethyl carbonate, ethylene carbonate, propylene carbonate, cellosolve acetate, butyl carbitol acetate, ethyl acetacetate, methyl cyanoacetate, or ethyl cyanoacetate; nitrogen-containing compounds such as nitromethane, nitrobenzene, acetonitrile, propionitrile, succinonitrile, valeronitrile, benzonitrile, ethylamine, diethylamine, ethylenediamine, aniline, N-methylaniline, N,N-dimethylaniline, o-toluidine, p-toluidine, piperidine, pyridine, α-picoline, 2,6-lutidine, quinoline, propylenediamine, formamide, N-methylformamide, N,N-dimethylformamide, N,N-diethylformamide, acetamide, N-methylacetamide, N-methylpropionamide, N,N,N',N'-tetramethylurea, or N-methylpyrrolidone; sulfur-containing compounds such as dimethyl sulfoxide or sulfolane; hydrocarbons such as benzene, p-cymene, naphthalene, cyclohexylbenzene, or cyclohexane; and halogenated hydrocarbons such as 1,1-dichloroethane, 1,2-dichloroethane, 1,1,1-trichloroethane, 1,1,1,2-tetrachloroethane, 1,1,2,2-tetrachloroethane, pentachloroethane, 1,2-dichloroethylene(cis-), tetrachloroethylene, 2-chlorobutane, 1-chloro-2-methylpropane, 2-chloro-2-methylpropane, bromomethane, tribromomethane, or 1-bromopropane. Further, at least two types of the above liquids may be mixed and then employed.

Further, conducting paste containing much substances (silver dust or the like) having high electrical conductivity is used as liquid L, and when conducting ejecting, target substances to be dissolved or dispersed in the aforesaid liquid L are not restricted in particular, provided that coarse particles which cause clogging in a nozzle are removed.

As phosphors such as PDP, CRT and FED, those which have been known can be used without restriction. For example, (Y, Gd) $BO_3$: Eu, $YO_3$: Eu and others are given as a red phosphor, $Zn_2SiO_4$: Mn, $BaAl_{12}O_{19}$: Mn, (Ba, Sr, Mg) O.α-$Al_2O_3$: Mn and others are given as a green phosphor, and $BaMgAl_{14}O_{23}$: Eu, $BaMgAl_{10}O_{17}$: Eu and others are given as blue phosphor.

In order to allow the above targeted substances to firmly adhere onto recording media, it is preferable to incorporate various types of binders. Examples of usable binders include cellulose and derivatives thereof such as ethyl cellulose, methyl cellulose, nitrocellulose, cellulose acetate, hydroxyethyl cellulose; alkyd resins; acrylic resins such as polymethacrylic acid, polymethyl methacrylate, 2-ethylhexyl methacrylate-methacrylic acid copolymer, lauryl methacrylate-2-hydroxyethyl methacrylate copolymer, and metal salts thereof; poly(meth)acrylamide resins such as polyN-isopropylacrylamide or polyN,N-dimethylacrylamide; styrene based resins such as polystyrene, acrylonitrile-styrene copolymer, styrene-maleic acid copolymer, or styrene-isoprene copolymer; styrene-acrylic resins such as styrene-n-butyl methacrylate copolymer; various saturated or unsaturated polyester resins; polyolefin based resins such as polypropylene; halogenated polymers such as polyvinyl chloride or polyvinylidene chloride; vinyl based resins such as polyvinyl acetate or vinyl chloride-vinyl acetate copolymer; polycarbonate resins; epoxy based resins; polyurethane based resins; polyacetal resins such as polyvinyl formal, polyvinyl butyral, or polyvinyl acetal; polyethylene based resins such as ethylene-vinyl acetate copolymer or ethylene-ethyl acrylate copolymer resins: amide resins such as benzoguanamine; urea resins; melamine resins; polyvinyl alcohol resins and anion cation modified resins thereof; polyvinylpyrrolidone and copolymer thereof; alkylene oxide homopolymer, copolymer, and linked polymer such as polyethylene oxide, carboxylated polyethylene oxide; polyalkylene glycols such as polyethylene glycol or polypropylene glycol; polyether polyol; SBR and NBR latexes; dextrin; sodium alginate; gelatin and derivatives thereof; natural or semi-synthetic resins such as casein, Hibisus manihot L., tragant gum, pullulan, gum Arabic, locust bean gum, gua gum, pectin, carageenan, glue, albumin, various starches, corn starch, alimentary yam paste, gloiopeltis, agar-agar, or soybean protein; terpene resins, ketone resins; rosin and rosin esters; and others such as polyvinyl methyl ether, polyethyleneimine, polystyrenesulfonic acid, or polyvinylsulfonic acid. These resins may be employed in the form of homopolymer and also employed while blended in their compatible range.

When liquid ejection device 1 is used as a patterning means, it can be used for a display use as a typical one. Specifically, it can be used for forming of a phosphor for a plasma display, forming of a rib of a plasma display, forming of an electrode for a plasma display, forming of a phosphor of CRT, forming of a phosphor of FED (field emission type display), forming of a rib of FED, a color filter for a liquid crystal display (RGB colored layers, black matrix layer) and a spacer for a liquid crystal display (pattern corresponding to black matrix, dot pattern).

Incidentally, a rib generally means a barrier, and it is used for separating a plasma area of each color, in an example of a plasma display. Other applications thereof include patterning coating such as magnetic materials, ferroelectric substances and conducting paste (wiring, antenna) as a micro-lens and a semiconductor, ordinary printing, printing on special medium (film, cloth, steel plate and others), printing on a curved surface and lithographic plates for various printing plates, as graphic application coating employing the invention such as gluing agents and sealing agents as application for processing, and coating of samples for diagnoses for drugs (wherein plural components in a very small quantity are mixed) and genes, as biologic and medical applications.

Now, a principle of ejecting liquid L in liquid ejection head 2 of the invention will be explained as follows, referring to the present embodiment.

In the present embodiment, electrostatic voltage is applied on electrode 16 for charging from charging-voltage power source 18 to cause an electric field to be generated between liquid L in ejection hole 13 of nozzle 10 and the surface of the opposing electrode 3 facing the liquid ejection 2. Further, drive voltage is applied on piezoelectric element 22 from drive voltage power source 23 to cause the piezoelectric element 22 to be deformed, whereby, a meniscus of liquid L is formed on ejection hole 13 of nozzle 10 by pressure generated on the liquid L.

Figure 3:
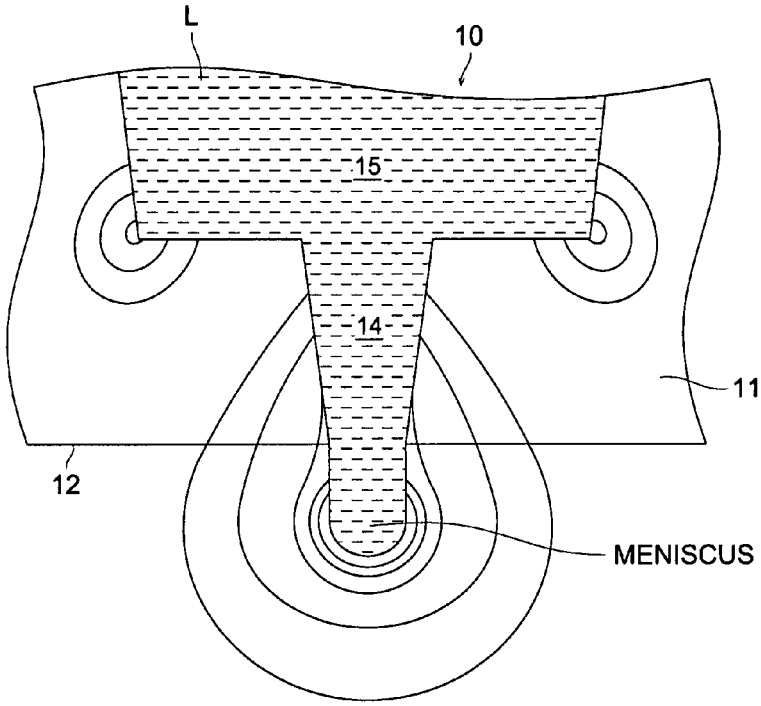
FIG. 3 is a schematic diagram showing electric potential distribution in the vicinity of an ejection hole of a nozzle by simulation.

When insulation property of nozzle plate 11 grows higher as in the present embodiment, equipotential lines stand side by side inside the nozzle plate 11 in the direction that is substantially perpendicular to ejection surface 12 as shown with equipotential lines by simulation in FIG. 3, and a strong electric field oriented toward liquid L in small diameter portion 14 of nozzle 10 and the meniscus of liquid L is generated.

In particular, extremely strong electric fields are concentrated on the tip portion of the meniscus, as is understood from equipotential lines which are dense at the tip portion of the meniscus in FIG. 3. Owing to this, the meniscus is torn off by the electrostatic force of the electric field to be separated from liquid L in the nozzle to become liquid droplet D. In addition, the liquid droplet D is accelerated by electrostatic force to be attracted to base material K supported by opposing electrode 3 to make impact. In that case, an angle for impacting on base material K is stabilized to make impacting to be accurate, because the liquid droplet D is made by an action of electrostatic force to make impact at the closer position.

As stated above, if the principle of ejection of liquid L in the liquid ejection head 2 of the invention is utilized, it is possible, even on the liquid ejection head 2 having a flat ejection surface, to generate concentration of strong electric fields by using nozzle plate 11 having high non-conductance and by generating a voltage difference in the direction perpendicular to the ejection surface 12, and thereby to form accurate and stable ejection state for liquid L.

In the experiments which were made by the present inventors based on the following conditions of the experiments by constituting so that an electric field intensity of the electric field between electrodes may be 1.5 kV/mm which is a practical value, and by forming nozzle plates 11 with various types of insulators, liquid droplets D were ejected from the nozzle 10 in some cases, and they were not ejected from the nozzle 10 in other cases.

[Conditions of the Experiments]

Distance between ejection surface 12 of nozzle plate 11 and an opposing surface of opposing electrode 3: 1.0 mm Thickness of nozzle plate 11: 125 μm Nozzle diameter: 10 μm Electrostatic voltage: 1.5 kV Drive voltage: 20 V In the experiments by the actual equipment, electric field intensity on the tip portion of the meniscus was obtained for all occasions where liquid droplets D were ejected stably from the nozzle 10. Actually, the simulation by a current distribution analysis mode was used for calculation by "PHOTO-VOLT" (product name, made by PHOTON Co, Ltd.), which is an electric field simulation software, because it was difficult to measure directly the electric field intensity on the tip portion of the meniscus. As a result, the electric field intensity on the tip portion of the meniscus was $1.5\times10^7$ V/m (15 kV/mm) or more in all cases.

Figure 4:
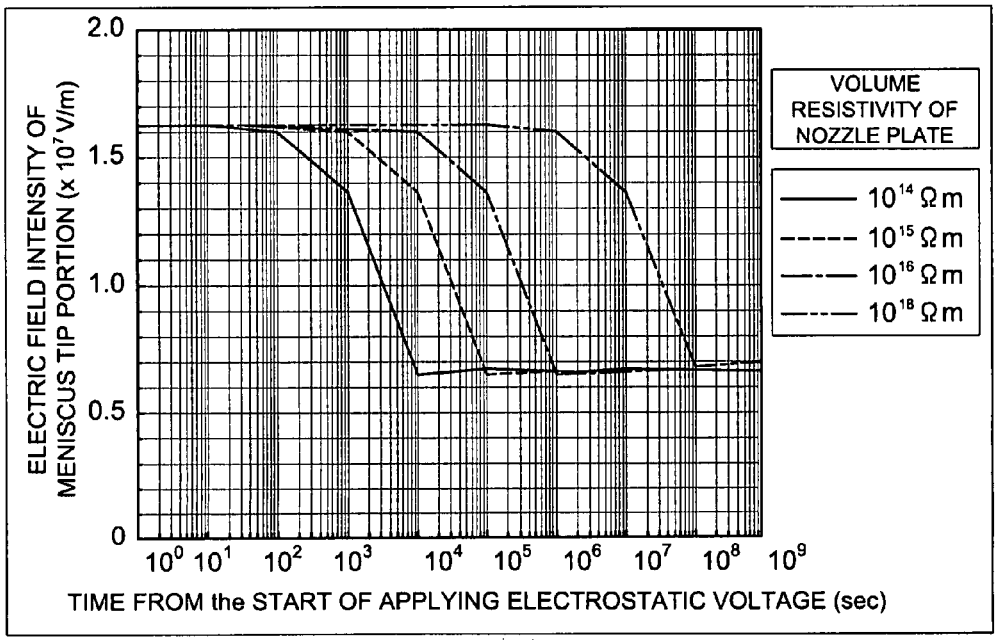
FIG. 4 is a diagram showing relationship between electric field intensity on a tip of the meniscus and a volume resistivity of a nozzle plate.

Further, as a result of calculating the electric field intensity on the tip portion of the meniscus by inputting the same parameters as in the aforesaid experiments in the same software, it was found out that the electric field intensity strongly depends on the volume resistivity of the insulator used for nozzle plate 11 as shown in FIG. 4.

FIG. 4 shows calculated result of changing states of electric field intensity of meniscus tip portion, after the start of applying statistic electrical field in the case where volume resistivity of the insulator used for nozzle plate 11 is $10^{14}$ Ωm-$10^{18}$ Ωm. In this calculation, the volume resistivity of air is assumed to be $10^{20}$ Ωm. In FIG. 4, caused by ionic polarization of the insulator used for nozzle plate 11, in cases where the volume resistivity of the insulator is $10^{14}$ Ωm, the electric field intensity of meniscus tip portion decreases rapidly after 100 seconds from the start of applying the static electric field. The period from the start of applying static electric field to the start of decreasing of the electric field intensity of meniscus tip portion is determined by the ratio of volume resistivity of air and volume resistivity of the insulator used from the nozzle plate 11. The higher the volume resistivity of the insulator used for the nozzle plate 11, the more the time for the electric field intensity of meniscus tip portion to start decreasing is delayed. Namely, the higher the volume resistivity of the insulator, the longer the time becomes when necessary electric field intensity can be obtained, which being preferable.

In documents, volume resistivity of the substance regarded as an insulator or a dielectric is $10^{10}$ Ωm or more in many cases, and the volume resistivity of borosilicate glass (for example, PYREX (registered trade mark) glass) that is known as a typical insulator is $10^{14}$ Ωm.

However, in the case of an insulator having the volume resistivity of this kind, liquid droplet D is not ejected. The reason is estimated that during the evaluation or before the evaluation of the ejection, the electric field intensity so decreased that necessary electric field intensity can not be obtained. Further, the case where the volume resistivity of air is assumed to be $10^{20}$ Ωm agreed with the experimental result, considering from the period required for the ejection evaluation and observation period. Once, the electric field intensity at meniscus tip portion has decreased, it is necessary to eliminate the ionic polarization of the insulator used for the nozzle plate 11 to restore the initial condition. It is necessary that the electric field intensity on the tip portion of the meniscus is $1.5\times10^7$ V/m or more for ejecting liquid droplet D stably from nozzle 10 as state above, and it was found out, from FIG. 4, that the volume resistivity of the nozzle plate 11 needs to be $10^{15}$ Ωm or more, by which the electric field intensity at the meniscus tip portion can be maintained for at least 1000 seconds (15 minutes), is necessary for practical use. This agreed with the experimental result.

The reason for the distinctive relationship between the volume resistivity of nozzle plate 11 and the electric field intensity on the tip portion of the meniscus is considered to be circumstances that if the volume resistivity of the nozzle plate 11 is low, equipotential lines do not stand side by side inside the nozzle plate 11 in the direction that is substantially perpendicular to ejection surface 12 as shown in FIG. 3, even when electrostatic voltage is applied, and electric field concentratios for liquid L and for the meniscus of liquid L are no conducted sufficiently.

Theoretically, even in the case of nozzle plate 11 having volume resistivity of less than $10^{15}$ Ωm, if the electrostatic voltage is made to be extremely high, there is a possibility that liquid droplet D is ejected from nozzle 10, but there is a fear that base material K is damaged by generation of spark between electrodes, which, therefore, is not adopted.

The distinctive and dependence relationship of the electric field intensity on the tip portion of the meniscus shown in FIG. 4 for the volume resistivity of nozzle plate 11 is obtained in the same way, even when simulation is conducted by changing a nozzle diameter variously, and it was found out that electric field intensity on the tip portion of the meniscus becomes $1.5\times10^7$ V/m when the volume resistivity is $10^{15}$ Ωm or more in any case. Further, a thickness of nozzle plate 11 in the aforesaid experiment conditions is the same as the sum of a length of small diameter portion 14 and a length of large diameter portion 15, in the present embodiment.

On the other hand, even when the nozzle plate 11 is made by using an insulator having volume resistivity of $10^{15}$ Ωm or more, there still are some cases where liquid droplet D is not ejected from nozzle 10. As is shown in the following Example 1, it was found out that the absorptance of the nozzle plate 11 for a liquid needs to be 0.6% or less, in the experiments wherein a liquid containing conductive solvent such as water is used as liquid L.

The reason for the foregoing is considered as follows; when nozzle plate 11 absorbs conductive solvents from liquid L, molecules such as water molecules representing conductive liquids are considered to exist in the nozzle plate 11 that is originally insulating, which enhances electric conductivity of the nozzle plate 11 accordingly, then, lowers especially a value of effective volume resistivity of a localized area that is in contact with liquid L, and weakens the electric field intensity on the tip portion of the meniscus, following the relationship shown in FIG. 4, thus, concentration of electric field necessary for ejecting liquid L is not obtained.

In the following Example 1, on the other hand, it was found out that the nozzle plate 11 ejects liquid L independently of the absorptance of the nozzle plate 11 for the liquid if the volume resistivity of the nozzle plate 11 is $10^{15}$ Ωm or more, when a liquid wherein chargeable particles are dispersed in an insulating solvent is used as liquid L. The reason for this is considered that the electric conductivity of the nozzle plate 11 is not changed greatly even when insulating solvent is absorbed in the nozzle plate 11, because electric conductivity of the insulating solvent is low, and thereby, the effective volume resistivity is not lowered.

Incidentally, the chargeable particles dispersed in the insulating solvent are not absorbed in the nozzle plate 11 even when they are metallic particles having extremely high electric conductivity, for example, thus the chargeable particles do not enhance electric conductivity of the nozzle plate 11 accordingly. In the meantime, the aforesaid insulating solvent means a solvent which is not ejected alone by electrostatic suction force, and examples thereof include xylene, toluene and tetradecane. Further, a conductive solvent means a solvent whose electric conductivity is $10^{-10}$ S/cm or more.

Figure 5:
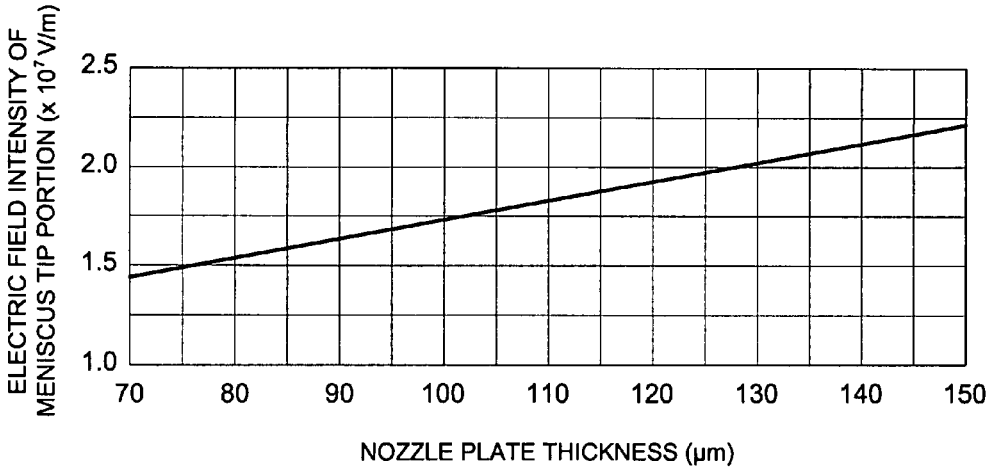
FIG. 5 is a diagram showing relationship between electric field intensity on a tip of the meniscus and a thickness of a nozzle plate.
Figure 6:
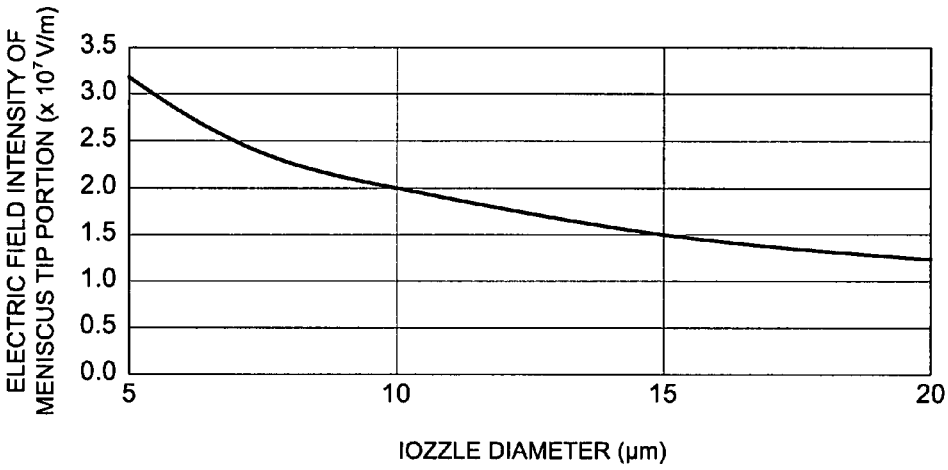
FIG. 6 is a diagram showing relationship between electric field intensity on a tip of the meniscus and a nozzle diameter.

Further, the electric field intensity on the tip portion of the meniscus on the occasion where a thickness of the nozzle plate 11 was changed and that on the occasion where a nozzle diameter was changed, both in the aforesaid simulation, are shown respectively in FIG. 5 and FIG. 6. This result shows that the electric field intensity on the tip portion of the meniscus depends also on a thickness of nozzle plate 11 and on a nozzle diameter, and it is preferable that a thickness of nozzle plate 11 is 75 μm or more and a nozzle diameter is 15 μm or less. In the meantime, the aforesaid appropriate ranges for the thickness of nozzle plate 11 and the nozzle diameter are confirmed in the experiments by actual equipment as shown in the following Example 2.

The reason why the electric field intensity on the tip portion of the meniscus depends on a thickness of nozzle plate 11 is considered to be the circumstances wherein, when a thickness of nozzle plate 11 grows thicker, a distance between ejection hole 13 on nozzle 10 and electrode 16 for charging grows greater, and equipotential lines in the nozzle plate tend to stand side by side in the substantially vertical direction, thus, concentration of electric fields toward the tip portion of the meniscus tends to be caused.

Further, when the nozzle diameter is made to be smaller, a diameter of the meniscus is made smaller, and when electric fields are concentrated on the tip portion of the meniscus whose diameter has been made smaller, an extent of electric field concentration becomes higher, which makes it consider that the electric field intensity on the tip portion of the meniscus grows higher.

Incidentally, with respect to the relationship between a thickness of nozzle plate 11 and electric field intensity of the tip portion of the meniscus shown in FIG. 5 and to the relationship between a nozzle diameter and electric field intensity of the tip portion of the meniscus shown in FIG. 6, the same simulation results have been obtained even for a single-step structure, namely, for the occasion of a simple taper-shaped nozzle or a cylindrical nozzle, or a multi-step nozzle, in addition to the occasion of nozzle 10 of a two-step structure composed of small diameter portion 14 and large diameter portion 15 as in the present embodiment.

Figure 7:
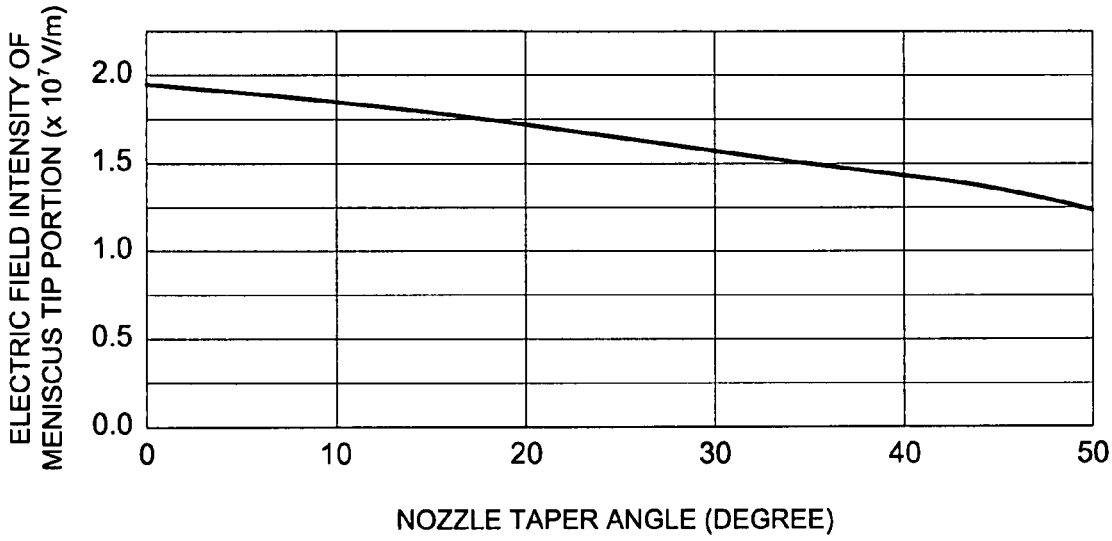
FIG. 7 is a diagram showing relationship between electric field intensity on a tip of the meniscus and a taper angle of a nozzle.

Further, FIG. 7 shows how the electric field intensity on the tip portion of the meniscus is varied when a taper angle of nozzle 10 is changed, in nozzle 10 of a taper-shaped or a cylindrical single-step structure without distinction of small diameter portion 14 and large diameter portion 15, in the aforesaid simulation. From this result, it is understood that the electric field intensity on the tip portion of the meniscus depends on the taper angle of nozzle 10. It is preferable that a taper angle of nozzle 10 is 30° or less. The taper angle in this case means an angle formed by an inner surface of the nozzle 10 and a normal line on ejection surface 12 of nozzle plated 11, and a taper angle that is 0° means that the nozzle 10 is in a shape of a cylinder.

Next, actions of liquid ejection head 2 and of liquid ejection device 1 in the present embodiment will be explained as follows.

Figure 8:
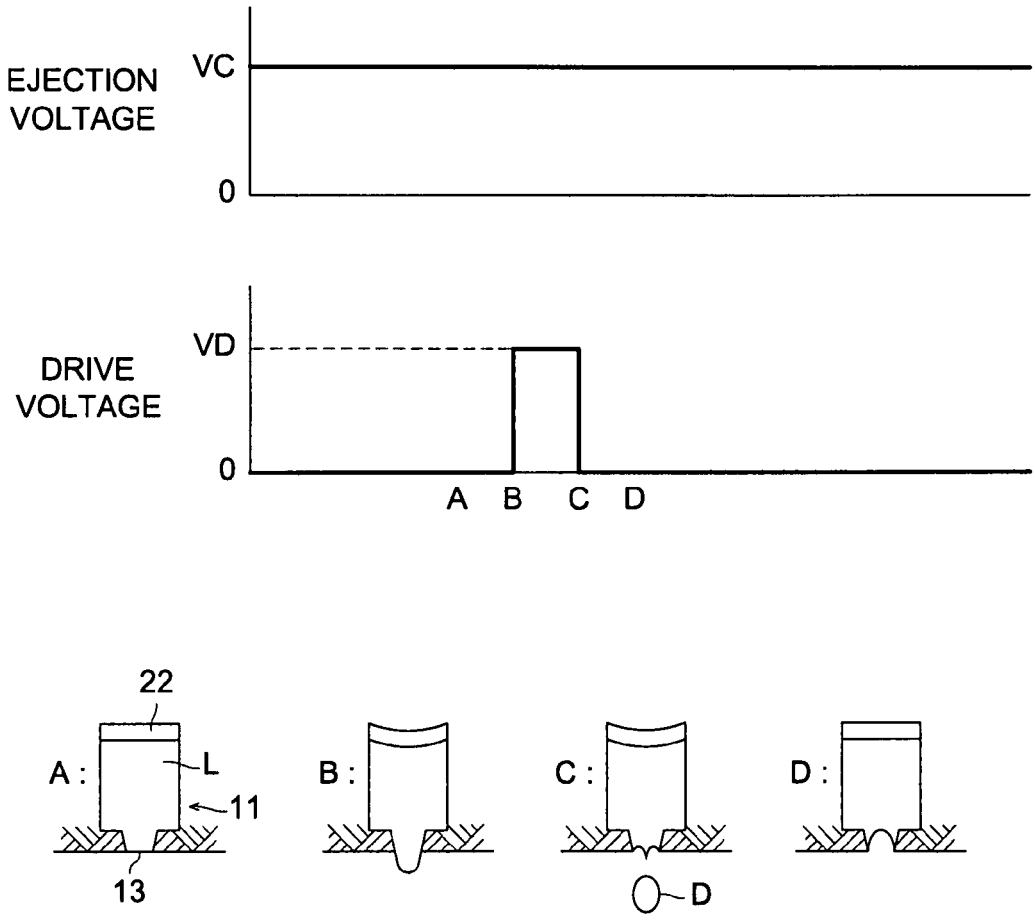
FIG. 8 is a diagram showing an example of drive control for a liquid ejection head in a liquid ejection device of the present embodiment.

FIG. 8 is a diagram illustrating drive control for a liquid ejection head in a liquid ejection device of the present embodiment. In the present embodiment, action-control section 24 of liquid ejection device 1 applies fixed electrostatic voltage Vc on electrode 16 for charging from charging-voltage power source 18. Owing to this, fixed electrostatic voltage Vc is applied constantly on each nozzle 10 of liquid ejection head 2, and an electric field is generated between liquid ejection head 2 and opposing electrode 3.

Further, for nozzle 10 to eject liquid droplet D, the action-control section 24 causes pulse-shaped drive voltage $V_D$ to be applied on piezoelectric element 22 from drive voltage power source 23 that corresponds to the nozzle 10. When the drive voltage $V_D$ of this kind is applied, the piezoelectric element 22 is deformed to enhance pressure of liquid L inside the nozzle, and the meniscus starts protruding from the state shown with A in the drawing to become the state where the meniscus is protruded sufficiently as shown with B.

Then, as stated above, electric fields are highly concentrated on the tip portion of the meniscus to extremely enhance the electric field intensity, thus, strong electrostatic force is applied to the meniscus from the electric field formed by the aforesaid electrostatic voltage $V_c$. The meniscus is torn off through the suction by this strong electrostatic force and through the pressure by the piezoelectric element 22 as shown with C in the drawing, and liquid droplet D is formed. The liquid droplet D is accelerated by the electric field to be sucked toward the opposing electrode, to make impact on base material K supported by the opposing electrode 3.

In that case, air resistance is applied on the liquid droplet D. However, as stated above, actions of electrostatic force cause the liquid droplet D to make impact on the closer position, whereby, the direction of impact on base material K is not deviated, and is stabilized to make impact on base material K accurately.

In the present embodiment, fixed electrostatic voltage $V_c$ to be applied on electrode 16 for charging from charging-voltage power source 18 is set to 1.5 kV, while, pulse-shaped drive voltage $V_D$ to be applied on piezoelectric element 22 from drive voltage power source 23 is set to 20 V.

Figure 9:
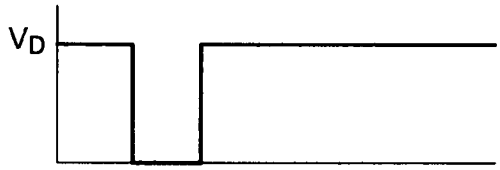
FIG. 9 is a diagram showing a variation example of drive voltage for applying on a piezoelectric element.
Figure 9:
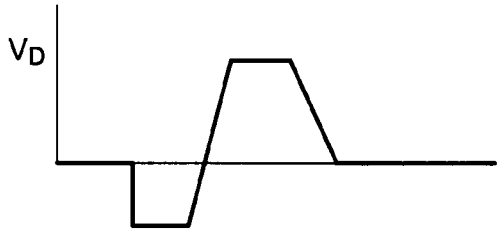
Figure 9:
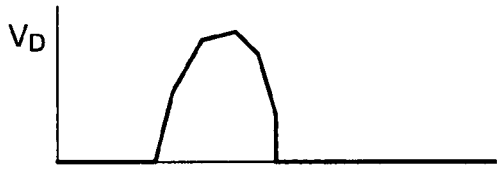

Incidentally, as drive voltage $V_D$ to be applied on piezoelectric element 22, it can be made to be pulse-shaped voltage as in the present embodiment. In addition to this, it is also possible to arrange so that triangular voltage wherein voltage is enhanced gradually and then, is lowered gradually, trapezoidal voltage wherein voltage is enhanced gradually, then, a fixed value is kept instantaneously, and voltage is lowered gradually, or sine wave voltage may be applied. Further, as shown in FIG. 9 (A), it is also possible to make an arrangement wherein voltage $V_D$ is applied constantly on the piezoelectric element 22, and then, the voltage is turned off temporarily, then, voltage $V_D$ is applied again to eject liquid droplet D in the course of its rising time period. It is further possible to make an arrangement to apply various drive voltages $V_D$ shown in FIGS. 9 (B) and 9 (C), and they are determined properly.

In the liquid ejection head 2 and liquid ejection device 1 of the present embodiment, the liquid ejection head 2 is made to be a head having flat ejection surface 12 as stated above, in which an illustration is omitted. Therefore, even when members such as a blade and a wiper come in contact with ejection surface 12 in the course of cleaning of the liquid ejection head 2, troubles such as an occasion where the nozzle 10 is damaged or the like are not caused, resulting in excellent operationally.

Further, in manufacturing of the liquid ejection head 2, it is not necessary to form a microstructure such as a protrusion of nozzle 10, and a structure is simple, thus, the liquid ejection head 2 can be manufactured easily and it is excellent in productivity.

Further, by using a material having volume resistivity of $10^{15}$ Ωm or more for the nozzle plate 11 on which nozzle 10 is formed, it is possible to concentrate electric fields on the meniscus of liquid L formed on an ejection hole portion of nozzle 10 by deformation of the piezoelectric element 22, even when electrostatic voltage to be applied on electrode 16 for charging is as low as about 1.5 kV, and the electric field intensity on the tip portion of the meniscus can be made to be $1.5\times10^7$ V/m or more under which the liquid droplet D can be eject stably.

Since the liquid ejection head 2 in the present embodiment can generate the electric field concentration that is the same as that for the head whose nozzle is protruded, on the tip portion of the meniscus effectively, despite its flat head, as stated above, a liquid can be ejected effectively and accurately even in the case where low electrostatic voltage is applied.

Though the present embodiment employs the constitution wherein the meniscus formed by deformation of piezoelectric element 22 is parted by electrostatic suction force into liquid droplets each being accelerated by an electric field formed by electrostatic voltage $V_c$ to make impact on base material K, it is also possible to employ the constitution to apply high drive voltage that is enough to make liquid L to be a liquid droplet with only pressure caused by deformation of the piezoelectric element 22, for example.

Though there has been shown the occasion to use deformation of the piezoelectric element 22 as a pressure generating means that generates pressure on liquid L in the nozzle and thereby forms a meniscus of liquid L on ejection hole 13 of the nozzle 10, the pressure generating means is not limited to the foregoing if it has the aforesaid function, and it is also possible to employ the constitution wherein, for example, liquid L in nozzle 10 and liquid L in cavity 20 are heated to generate bubbles, and pressure thereof is used.

In the present embodiment, there has been explained an occasion where the opposing electrode 3 is grounded. However, it is also possible to constitute to apply voltage on opposing electrode 3 from the power source and thereby to control the power source with action-control section 24 so that a voltage difference from electrode 16 for charging may become the prescribed voltage difference such as 1.5 kV.

EXAMPLE

Example 1

Nozzle plates 11 of liquid ejection head 2 of the present embodiment were actually prepared by using various types of materials, and whether liquid droplet D is ejected from ejection hole 13 of nozzle 10 or not was confirmed by ejecting on base material K.

The structure of the liquid ejection head 2 was made to be a single-step structure made under the same conditions as the aforesaid experiment conditions wherein a taper angle of nozzle 10 is 4° and small diameter portion 14 and large diameter portion 15 are continuous.

Further, liquid L1 was prepared as a conductive liquid that contains 52% by weight of water, 22% by weight of ethylene glycol, 22% by weight of propylene glycol, 3% by weight of dye (CI Acid Red 1) and 1% by weight of surfactant, while, liquid L2 was prepared as a conductive liquid wherein 3% by weight of dye (the same as the above) is contained in ethanol and liquid L3 was prepared as a liquid wherein Ag particles are dispersed in tetradecane, and chargeable particles are dispersed in an insulating solvent.

Incidentally, the volume resistivity was obtained through calculating of an electrical resistance value obtained by applying voltage between surfaces of sheet-shaped substances to be measured in conformity with JISC2151. The absorptance of the nozzle plate 11 for a liquid was calculated from the rate of change for weight of nozzle plate 11 or of a substance to be measured by dipping the nozzle plate 11 or the substitute sheet-shaped substance to be measured in liquid L representing an object at 23° C. to be used for 24 hours, and by measuring weight of the nozzle plate 11 or the substance to be measured before and after dipping. When liquid L is water soluble ink, it is also possible to use a coefficient water absorption conforming ASTMD570 as a substitute.

The Table 1 below shows results of the experiments for the aforesaid liquids L1-L3. Incidentally, an upper step of a column of the absorptance in Table 1 represents the absorption) for water, and a absorptance for ethanol.

TABLE 1

| Material | Commercial name | Volume resistivity (Ωm) | Absorptance (%) | Ejected(E) or Not Ejected(NE) L1 | L2 | L3 |
|---|---|---|---|---|---|---|
| Polybutylene terephthalate (PBT) | NOVADURAN (made by Mitsubishi Engineering-Plastics Corporation | $1.0 \times 10^{14}$ | 0.1 | NE | | NE |
| Polycarbonate (PC) | NOVAREX (made by Mitsubishi Engineering-Plastics Corporation) | $3.0 \times 10^{14}$ | 0.24 | NE | | NE |
| Polyimide (PI) | KAPTON (made by DU PONT-TORAY CO., LTD. | $1.0 \times 10^{15}$ | 2.9 | NE | | E |
| Polyimide (PI) | UPILEX-S (made by UBE Industries, Ltd.) | $1.0 \times 10^{15}$ | 1.4<br>1.3 | NE | NE | E |
| Engineering Plastic Film | SUPERIO-UT (made by Mitsubishi Chemical Corporation) | $1.0 \times 10^{15}$ | 0.6 | E | | E |
| Polyimide (PI) | UPIMOL SA101 (made by UBE Industries, Ltd.) | $1.0 \times 10^{15}$ | 0.5 | | E | |
| Polybutylene terephthalate (PEI) | TOYOBO ESTER FILM (made by TOYOBO CO., LTD.) | $1.0 \times 10^{15}$ | 0.3 | E | | E |
| Polyetherimide (PEI) | ULTEM 1000 (made by GE Plastics Corporation) | $1.0 \times 10^{15}$ | 0.25 | E | | E |
| Polystylene (PS) | GPPS (made by PS Japan Corporation) | $1.0 \times 10^{15}$ | 0.1 | E | | E |
| Allyl ester resin | G1030S (made by SHOWA DENKO K.K.) | $1.7 \times 10^{15}$ | 0.57 | E | | E |
| Liquid crystal polyester (LCP) | SIVERAS (made by TORAY INDUSTRIES) | $4.0 \times 10^{15}$ | 0.2 | E | | E |
| Polyethylene terephthalate (PET) | LUMIRROR (made by TORAY INDUSTRIES) | $5.0 \times 10^{15}$ | 0.4 | E | | E |
| Deformed polyphenylene ether(PPE) | Iupiace (made by Mitsubishi Engineering-Plastics Corporation) | $6.0 \times 10^{15}$ | 0.07 | E | | E |
| Polyethylene naphthalate (PEN) | Teonex (made by Teijin DuPont Film Japan Limited) | $1.0 \times 10^{16}$ | 0.3 | E | | E |
| Polyterafluoro ethylene (PTFE) | NITOFLON (made by NITTO DENKO Corporation) | $1.0 \times 10^{16}$ | 0<br>0 | E | E | E |
| Polypropylene (PP) | Torayfan2500S (made by TORAY INDUSTRIES) | $6.0 \times 10^{16}$ | 0.01 | E | | E |
| Quartz glass | Synthetic Quartz Glass ES grade (made by TOSO CORPORATION) | $1 \times 10^{15}$ | 0<br>0 | E | E | E |

Results of Table 1 indicate that when conductive solvents are contained as in Liquid L1 and liquid L2, liquid L is not ejected from nozzle 10 for the material whose volume resistivity is less than $10^{15}$ Ωm, even if the absorptance for a liquid is low. This shows the same results as those of the aforesaid simulation. It is further understood that liquid L can be ejected from nozzle 10 if the material is one having a volume resistivity of $10^{15}$ Ωm or more, but liquid L is not ejected unless the volume resistivity is at least 0.6% or less.

On the other hand, it is understood that when ejecting a liquid wherein chargeable particles are dispersed in an insulating solvent as in liquid L3, all liquids can be ejected from nozzle 10 if the material is one whose volume resistivity is $10^{15}$ Ωm or more.

Example 2

Nozzle plates 11 of liquid ejection head 2 of the present embodiment were prepared by changing a thickness of nozzle plate 11 and a nozzle diameter variously, and whether the liquid L1 is ejected or not was confirmed by ejecting on base material K. Further, as a referential experiment, whether the liquid L1 is ejected or not was confirmed under the condition in which the liquid L1 was not ejected, by causing electrostatic voltage to be 3.0 kV.

Results of the experiments proved to be those shown in the following Table 2. Incidentally, nozzle plate 11 was formed by using polyethylene terephthalate, Lumirror (made by TORAY INDUSTRIES, INC.), described on Table 1.

TABLE 2

| Nozzle diameter (μm) | Nozzle plate thickness (μm) | Electrostatic voltage (KV) | Ejecting of liquid |
|---|---|---|---|
| 10 | 125 | 1.5 | G |
| 15 | 125 | 1.5 | G |
| 20 | 125 | 1.5 | NG |
| 20 | 125 | 3 | G |
| 15 | 100 | 1.5 | G |
| 15 | 75 | 1.5 | G |
| 15 | 50 | 1.5 | NG |
| 15 | 50 | 3 | G |

G: Good
NG: Not Good

When comparing the results of the occasion where a thickness of nozzle plate 11 is 125 μm, it is understood from the results of Table 2 that the nozzle diameter that is 15 μm or less is preferable. Further, if the result of the occasion where a nozzle diameter is 15 μm is compared, it is understood that a thickness of nozzle plate 11 which is 75 μm or more is preferable. In the meantime, when electrostatic voltage was made to be 3.0 kV under the condition in which a liquid was not ejected, the liquid was ejected in this case.

In the embodiment of the invention, electrostatic voltage is applied on liquids in a nozzle and a cavity of a liquid ejection head which is made of a material having volume resistivity of $10^{15}$ Ωm or more and has a flat ejection surface, thereby, an electric field is formed between the liquid ejection head and an opposing electrode, and pressure is applied on a liquid in the nozzle by a pressure generating portion, to form on an ejection hole of the nozzle a liquid meniscus to which electric fields are concentrated, thus the meniscus is sucked by suction force caused by electric field to become liquid droplets which are ejected.

Since the liquid ejection head is made to be a flat head accordingly, even when members such as a blade and a wiper come in contact with ejection surface in the course of cleaning of the liquid ejection head, troubles such as an occasion where the nozzle is damaged or the like are not caused, resulting in excellent operability. Further, in manufacturing of the liquid ejection head, it is not necessary to form a microstructure such as a protrusion of a nozzle, and a structure is simple, thus, the liquid ejection head can be manufactured easily and it is excellent in productivity.

Further, by using a material having volume resistivity of $10^{15}$ μm or more for the nozzle plate on which a nozzle is formed, it is possible to concentrate effectively electric fields on the meniscus of a liquid formed on an ejection hole portion of a nozzle by a pressure generating section, even when electrostatic voltage to be applied on a liquid in a nozzle from an electrostatic voltage applying section is voltage that is as low as about 2 kV or lower. Therefore, electric field intensity on the tip portion of the meniscus can be made to be the electric field intensity at which a liquid droplet can be ejected effectively and stably, thus, a liquid can be ejected from a minified nozzle, and it is also possible to eject a liquid with high viscosity.

In the embodiment of the invention, a liquid to be ejected from a nozzle of a liquid ejection head is one containing conductive solvents, and a material whose absorptance for a liquid is 0.6% or less is used for a nozzle plate of the liquid ejection head. When the absorptance is greater than this, the nozzle plate sometimes absorbs conductive solvents from a liquid and its volume resistivity is lowered, making it impossible for a liquid to be ejected stably from a nozzle. However, if the absorptance for a liquid is 0.6% or less, occurrence of the troubles of this kind can be prevented effectively, which makes it possible for the aforesaid effect of the embodiment of the invention to be displayed more effectively.

In the embodiment of the invention, a liquid wherein chargeable particles are dispersed in insulating solvents is ejected from a liquid ejection head having a nozzle plate whose volume resistivity is $10^{15}$ Ωm or more. When using a liquid containing the insulating solvents of this kind as a liquid, chargeable particles are not absorbed in a nozzle plate, but insulating solvents only are absorbed. However, even if insulating solvents are absorbed in the nozzle plate, electric conductivity of the nozzle plate is not changed greatly because of the low electric conductivity of the insulating solvents, and effective volume resistivity is not lowered, whereby, if the volume resistivity of the nozzle plate is $10^{15}$ Ωm or more independently of its absorptance for a liquid, the nozzle plate can eject a liquid, which makes it possible for the aforesaid effect of the embodiment of the invention to be displayed more effectively.

In the embodiment of the invention, electric fields are concentrated effectively on the tip portion of the meniscus owing to a nozzle formed on the nozzle plate having volume resistivity of $10^{15}$ Ωm or more and having a thickness of 75 μm or more, thereby, the electric field intensity on the tip portion of the meniscus can be made to be $1.5\times10^{7}$ V/m or more necessary for ejecting a liquid stably, which makes it possible for the aforesaid effect of the embodiment of the invention to be displayed more accurately.

In the embodiment of the invention, electric fields are concentrated effectively on the tip portion of the meniscus owing to a nozzle that is formed so that an inner diameter of an ejection hole may become 15 μm or less, thereby, the electric field intensity on the tip portion of the meniscus can surely be made to be $1.5\times10^{7}$ V/m or more necessary for ejecting a liquid stably, which makes it possible for the aforesaid effect of the embodiment of the invention to be displayed more accurately.

In the embodiment of the invention, a decline of the electric field concentration on the tip portion of the meniscus caused by spread of the liquid meniscus formed on an ejection hole portion of the nozzle, can be prevented effectively by a liquid-repelling layer that repels a liquid which is provided on a flat ejecting surface of the liquid ejection head, which makes it possible for the aforesaid effect of the embodiment of the invention to be displayed more accurately.

In the embodiment of the invention, it is possible to enhance pressure of a liquid in a nozzle effectively with low voltage and to protrude a meniscus on an ejection hole of the nozzle greatly, because a piezoelectric actuator such as a piezoelectric element is used as a pressure generating portion which generates pressure on a liquid in the nozzle and forms a liquid meniscus on an ejection hole of the nozzle. Therefore, the aforesaid effect of the embodiment of the invention can be displayed effectively.

In the embodiment of the invention, a meniscus is formed on an orifice portion of the nozzle by the functions of pressure applied on a liquid in a nozzle of the liquid ejection head and of the electric field formed by electrostatic voltage applying portion between the liquid ejection head and an opposing electrode, and owing to this, strong electric field intensity is caused on the tip portion of the meniscus by the electric field concentration to transform the liquid into a liquid droplet which is accelerated by the electric field to make impact on the base material.

Therefore, functions of electrostatic suction force from the electric field cause the liquid droplet to make impact to the closer portion on the base material, whereby, an angle and others in the case of impact on the base material are stabilized, and the liquid droplet can make impact on the prescribed impact position accurately. Further, since the meniscus can be protruded greatly by low electrostatic voltage in the same way as in the aforesaid embodiment of the invention, a voltage value of electrostatic voltage to be applied by the electrostatic voltage applying section can be lowered, thus, the aforesaid effect of the embodiment of the invention can be displayed more effectively.

In the embodiment of the invention, pressure is applied on a liquid in a nozzle of the liquid ejection head by a pressure generating portion first in a liquid ejection device to form a meniscus on an orifice portion, and then, the meniscus is torn off by electrostatic suction force to be transformed into droplets. Therefore, if the meniscus is protruded sufficiently, the meniscus is torn off by electrostatic suction force of the electric field even if a liquid in a nozzle is not transformed into droplets by the pressure that is caused by the pressure generating portion, thus, it is possible to lower the drive voltage to be applied on the pressure generating portion to be lower, and to achieve reduction of power consumption of the liquid ejection device.

APPLICABILITY IN THE INDUSTRY

According to the present invention, by utilizing an electric field assist method, which controls the protrusion amount of meniscus to control the ejection, can be provided are a liquid ejection head, a liquid ejection apparatus and a liquid ejection method wherein a ejecting surface is flat, low voltage switching of meniscus generation drive is enabled, electric fields are concentrated effectively by applying of low electrostatic voltage and a liquid is ejected efficiently and the fine pattern can be formed and a liquid of high viscosity can be ejected.

The invention claimed is:

1. A liquid ejection head comprising:

a nozzle for ejecting a liquid;

a flat nozzle plate, on which the nozzle is provided;

a cavity to store the liquid to be ejected from an ejection hole of the nozzle;

a pressure generating section which generates pressure on the liquid in the nozzle and forms a meniscus of the liquid in the ejection hole of the nozzle;

an electrostatic voltage applying section which applies electrostatic voltage between a base material and the liquid in the nozzle and the cavity, and generates electrostatic suction force; and an operation control section which controls applying of the electrostatic voltage by the electrostatic voltage applying section, and controls applying of drive voltage to drive the pressure generating section, wherein a volume resistivity of the nozzle plate is $10^{15}$ Ωm or more.

2. The liquid ejection head described in claim 1, characterized in that the liquid contains a conductive solvent, wherein an absorption factor of the flat nozzle plate with respect to the liquid is 0.6% or less.

3. The liquid ejection head described in claim 1, characterized in that the liquid comprises an insulating solvent, and electrically chargeable particles dispersed in the insulating solvent.

4. The liquid ejection head described in claim 1, characterized in that a thickness of the flat nozzle plate is 75 μm or more.

5. The liquid discharge head described in claim 1, characterized in that an inner diameter of the ejection hole is 15 μm or less.

6. The liquid discharge head described in claim 1 characterized in that a liquid-repelling layer is provided on an ejection surface side of the nozzle plate.

7. The liquid ejection head described in claim 1, characterized in that the pressure generating section is a piezoelectric actuator.

8. A liquid ejection device comprising:

the liquid ejection head described in claim 1; and an opposing electrode which opposes to the liquid ejection head, wherein the liquid is ejected by the electrostatic suction force generated between the liquid ejection head and the opposing electrode, and by the pressure generated in the nozzle.

9. The liquid ejection device described in claim 8, characterized in that a liquid meniscus is protruded on the ejection hole of the nozzle by the pressure generated by the pressure generating section, and the liquid is ejected by the electrostatic suction force.

10. A liquid ejection method utilizing a liquid ejection head which comprises a nozzle for ejecting a liquid, a flat nozzle plate, having volume resistivity of $10^{15}$ Ωm or more, on which the nozzle is provided; the method comprising:

generating electrostatic field between the liquid ejection head and an opposing electrode provided to oppose the liquid ejection head, by applying an electrostatic voltage on the liquid in the nozzle and a cavity of the head;

generating pressure to the liquid in the nozzle, by a pressure generating section;

concentrating the electric field onto a meniscus, of the liquid at an ejection hole of the nozzle, formed by the pressure and electrostatic suction force caused by the electric field; and sucking and ejecting the liquid by the electrostatic suction force.

11. The liquid ejection method described in claim 10, characterized in that the liquid contains a conductive solvent, wherein an absorption factor of the nozzle plate with respect to the liquid is 0.6% or less.

12. The liquid ejection method described in claim 10, characterized in that the liquid comprises an insulating solvent, and electrically chargeable particles dispersed in the insulating solvent.

13. The liquid ejection method described in claim 10, characterized in that a thickness of the flat nozzle plate is 75 μm or more.

14. The liquid ejection method described in claim 10, characterized in that an inner diameter of the ejection hole is 15 μm or less.

15. The liquid ejection method described in claim 10, characterized in that a liquid-repelling layer is provided on an ejection surface side of the nozzle plate.

16. The liquid ejection method described in claim 10, characterized in that the pressure generating section is a piezoelectric actuator.

17. A liquid ejection method utilizing a liquid ejection head which comprises a nozzle for ejecting a liquid, a flat nozzle plate, having volume resistivity of $10^{15}$ Ωm or more, on which the nozzle is provided; the method comprising:

generating electrostatic field between the liquid ejection head and an opposing electrode provided to oppose the liquid ejection head, by applying an electrostatic voltage on the liquid in the nozzle and a cavity of the head;

concentrating the electric field onto a meniscus of the liquid at an ejection hole of the nozzle, by protruding the meniscus, through generating pressure to the liquid in the nozzle by a pressure generating section; and sucking and ejecting the liquid by the electrostatic suction force.

* * * * *